US010297194B2

(12) United States Patent
Kim

(10) Patent No.: US 10,297,194 B2
(45) Date of Patent: May 21, 2019

(54) ORGANIC LIGHT EMITTING DIODE DISPLAY DEVICE HAVING A TARGET CURRENT SETTING

(71) Applicant: LG DISPLAY CO., LTD., Seoul (KR)

(72) Inventor: Jung-Jae Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 41 days.

(21) Appl. No.: 15/390,162

(22) Filed: Dec. 23, 2016

(65) Prior Publication Data

US 2018/0061314 A1 Mar. 1, 2018

(30) Foreign Application Priority Data

Aug. 31, 2016 (KR) ..... 10-2016-0111946

(51) Int. Cl.
*G09G 3/3233* (2016.01)

(52) U.S. Cl.
CPC ..... *G09G 3/3233* (2013.01); *G09G 2300/043* (2013.01); *G09G 2300/0842* (2013.01); *G09G 2320/0233* (2013.01)

(58) Field of Classification Search
CPC ..... G09G 3/3233
USPC ..... 345/212
See application file for complete search history.

(56) References Cited

U.S. PATENT DOCUMENTS

2009/0140959 A1* 6/2009 Nam ..... G09G 3/3233 345/76
2009/0213046 A1* 8/2009 Nam ..... G09G 3/3233 345/76
2011/0292025 A1* 12/2011 Kishi ..... G09G 3/3233 345/212
2016/0358547 A1* 12/2016 Zhu ..... G09G 3/3233

* cited by examiner

*Primary Examiner* — Long D Pham
(74) *Attorney, Agent, or Firm* — Seed Intellectual Property Law Group LLP

(57) ABSTRACT

Disclosed is an organic light emitting diode (OLED) display device. The OLED display device includes a target current setting unit connected to a pixel via a data line, to set a target current meeting a data voltage during a sampling period before a holding period to a target current to drive an OLED element during the holding period. The pixel includes a drive thin film transistor (TFT) for driving the OLED element, a first switching TFT to connect the drive TFT to a first power line for the sampling period such that the drive TFT serves as a diode, a second switching TFT to connect a source electrode of the drive TFT to the data line for the sampling period, and a capacitor connected between gate and source electrodes of the drive TFT, to store a drive voltage for the drive TFT determined based on the target current.

15 Claims, 9 Drawing Sheets

ORGANIC LIGHT EMITTING DIODE DISPLAY DEVICE HAVING A TARGET CURRENT SETTING

This application claims the benefit of Korean Patent Application No. 10-2016-0111946, filed on Aug. 31, 2016, which is hereby incorporated by reference as if fully set forth herein.

BACKGROUND

Technical Field

The present disclosure relates to an organic light emitting display device, and more particularly to an organic light emitting display device having a pixel structure requiring no external compensation operation.

Description of the Related Art

Representative examples of a flat display device recently highlighted as a display device to display an image using digital data include a liquid crystal display (LCD) using liquid crystals, an organic light emitting diode (OLED) display using OLEDs, an electrophoretic display (EPD) using electrophoretic particles, and the like.

The OLED display device is a self-luminous device in which an organic light emitting layer emits light through re-combination of electrons and holes. Since the OLED display device exhibits high luminance, and uses a low drive voltage while achieving ultra-slimness, the OLED display device is expected to be a next-generation display device.

Such an OLED display device includes a plurality of pixels, each of which includes an OLED element, and a pixel circuit for driving the OLED element. The pixel circuit includes a switching thin film transistor (TFT) for supplying a data voltage to a storage capacitor, a drive TFT for controlling current in accordance with a drive voltage charged in the storage capacitor, and supplying the controlled current to the OLED element, and so on. The OLED element generates light having a light amount proportional to the amount of the current.

In OLED display devices of the related art, however, non-uniformity of luminance may occur because deviation of driving characteristics of drive TFTs such as threshold voltage and mobility among pixels due to process deviation, driving environments and drive time may occur and, as such, a variation in drive current at the same voltage may occur. In order to solve such a problem, OLED display devices use external compensation for sensing driving characteristics of each pixel, and compensating for deviation of driving characteristics of each pixel, using the sensed value.

For example, in a process of manufacturing an OLED display device and a process of practically driving the manufactured OLED display device, an external compensation operation is executed. In the external compensation operation, driving characteristics of each pixel are sensed, and a compensation value for compensation of deviation of driving characteristics of each pixel is determined, based on sensed information. The determined compensation value is stored in a memory. The OLED display device compensates data to be supplied to sub-pixels, using compensation values stored in the memory in the above-mentioned manner.

For this reason, such a OLED display device of the related art requires an additional time for external compensation in the process of manufacturing the OLED display device and the process of practically driving the OLED display device.

In addition, for acquisition of compensation values, a sensing circuit, a computation circuit, a memory and so on are needed. As a result, there may be drawbacks of loss of time and added circuit element expense.

BRIEF SUMMARY

Accordingly, the present disclosure is directed to an organic light emitting diode display device that substantially obviates or reduces one or more problems due to limitations and disadvantages of the related art.

An object of the present disclosure is to provide an organic light emitting diode display device having a pixel structure requiring no external compensation operation for sensing and compensation of characteristics of a drive thin film transistor (TFT) of each pixel.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, an organic light emitting diode display device includes a pixel, and a target current setting unit connected to the pixel via a data line, to set a target current meeting a data voltage during a sampling period before a holding period to a target current to drive an organic light emitting diode (OLED) element in the pixel during the holding period.

The pixel may include a drive thin film transistor (TFT) for driving the OLED element, a first switching TFT controlled by a first gate line, to connect the drive TFT to a first power line for the sampling period such that the drive TFT serves as a diode, a second switching TFT controlled by a second gate line, to connect a source electrode of the drive TFT to the data line for the sampling period, and a capacitor connected between a gate electrode of the drive TFT and the source electrode of the drive TFT, to store a drive voltage for the drive TFT determined based on the target current.

The pixel may include a TFT for driving the OLED element, a first switching TFT controlled by a first gate line, to connect the drive TFT to a first power line for the sampling period such that the drive TFT serves as a diode, a second switching TFT controlled by a second gate line, to connect a cathode of the OLED element to the data line for the sampling period, a third switching TFT controlled by a third gate line, to connect the cathode of the OLED element to a second power line for the holding period, and a capacitor connected between a gate electrode of the drive TFT and the source electrode of the drive TFT, to store a drive voltage for the drive TFT determined based on the target current. In this case, the second gate line and the second switching TFT may be dispensed with.

The target current setting unit may include a sink TFT and a resistor, which are connected in series between the data line and the second power line, and an amplifier for controlling an amount of current flowing through the sink TFT based on the data voltage before the sampling period, comparing the data voltage with a voltage fed back through a connection node between the sink TFT and the resistor during the sampling period, and controlling the amount of current flowing through the sink TFT based on results of the comparison.

The pixel may include a drive TFT for driving the OLED element, a first switching TFT controlled by a first gate line, to connect a gate electrode of the drive TFT to the data line for the sampling period, a second switching TFT controlled by a second gate line, to connect a source electrode of the drive TFT to the sensing line for the sampling period, and a capacitor connected between the gate electrode of the drive TFT and the source electrode of the drive TFT, to store a drive voltage for the drive TFT determined based on the target current.

The pixel may include a drive TFT for driving the OLED element, a first switching TFT controlled by a first gate line, to connect a gate electrode of the drive TFT to the data line for the sampling period, a second switching TFT controlled by a second gate line, to connect a cathode of the OLED element to the sensing line for the sampling period, a third switching TFT controlled by a third gate line, to connect the cathode of the OLED element to a second power line for the holding period, and a capacitor connected between the gate electrode of the drive TFT and the source electrode of the drive TFT, to store a drive voltage for the drive TFT determined based on the target current. In this case, the second gate line and the second switching TFT may be dispensed with.

The target current setting unit may include a sensing resistor connected between the sensing line and the second power line, and an error amplifier for applying the data voltage to the data line before the sampling period, and compensating a voltage output from the data line in accordance with a voltage fed back through a connection node between the sensing line and the sensing resistor during the sampling period.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and along with the description serve to explain the principle of the disclosure. In the drawings.

DETAILED DESCRIPTION

Hereinafter, preferred embodiments of the present disclosure will be described in detail with reference to the accompanying drawings.

Figure 1:
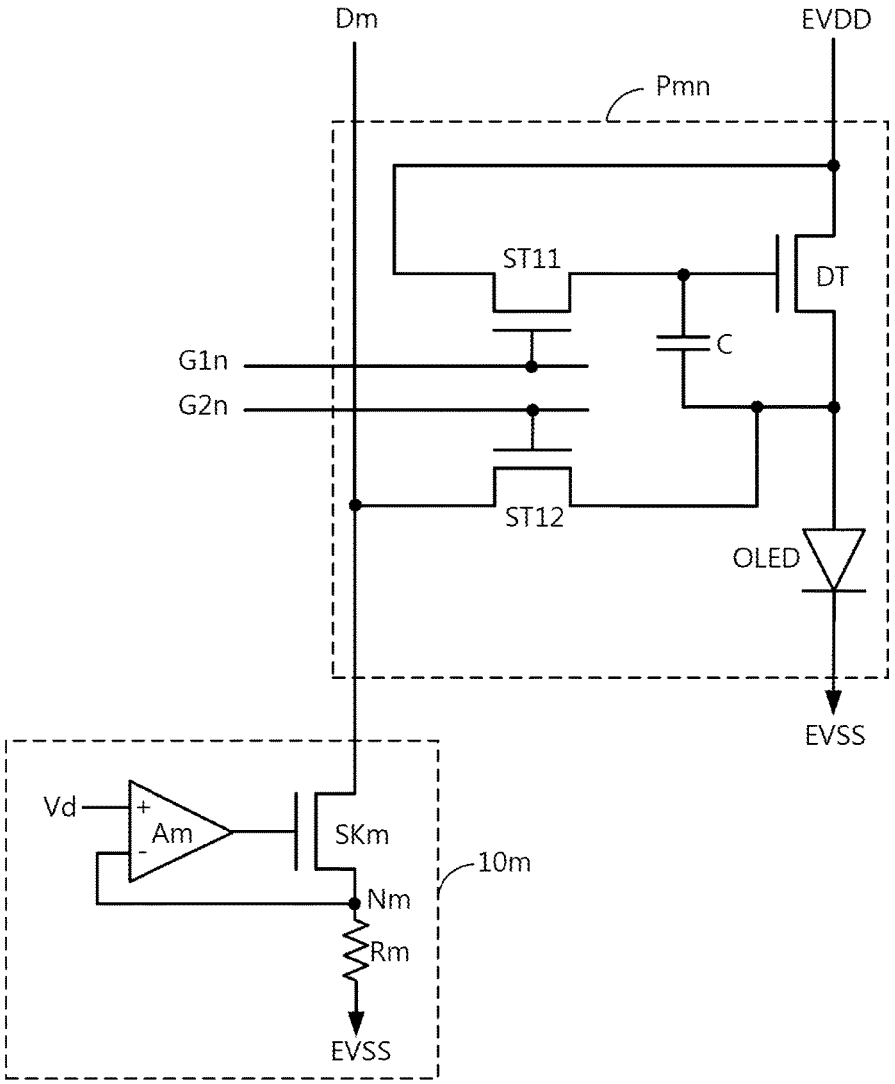
FIG. 1 is a circuit diagram illustrating a configuration of a part of an organic light emitting diode (OLED) display device according to a first embodiment of the present disclosure.
Figure 2:
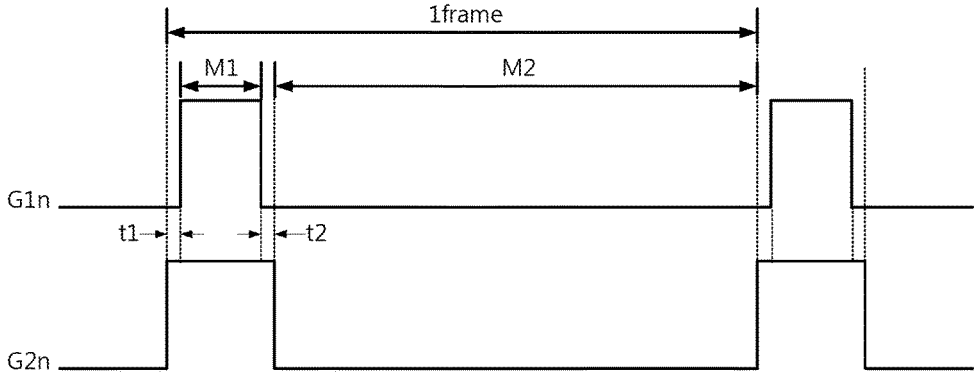
FIG. 2 is a waveform diagram illustrating driving of a pixel shown in FIG. 1.

FIG. 1 is a circuit diagram illustrating a configuration of a part of an organic light emitting diode (OLED) display device according to a first embodiment of the present disclosure. FIG. 2 is a waveform diagram illustrating driving of a pixel shown in FIG. 1.

In FIG. 1, a pixel Pmn represents a typical structure in one of a plurality of pixels arranged in a matrix on a display panel, namely, a pixel arranged on an m-th pixel column (m being a natural number) and an n-th pixel row (n being a natural number). In FIG. 1, a target current setting unit 10*m* represents one of a plurality of current sink circuits constituting constant current circuits in a data driver for respective data lines, namely, an m-th current sink circuit connected to an m-th data line Dm.

The pixel Pmn includes an OLED element, a drive thin film transistor (TFT) DT, a first switching TFT ST11, a second switching TFT ST12, and a capacitor C. For each of the drive TFT DT and the switching TFTs ST11 and ST12, an amorphous silicon (a-Si) TFT, a polysilicon (poly-Si) TFT, an oxide TFT or an organic TFT may be used.

The drive TFT DT is connected between a first power source line (hereinafter, the first power source is referred to as "EVDD") and an anode of the OLED element. The drive TFT DT supplies drive current to the OLED element by controlling an amount of current supplied from the EVDD line.

The capacitor C, which is connected between gate and source electrodes of the drive TFT DT, stores a drive voltage Vgs to maintain drive current flowing to the OLED element through the drive TFT DT.

The OLED element includes the anode, which is connected to the source electrode of the drive TFT DT, a cathode connected to a second power source (hereinafter, referred to as "EVSS"), and an organic light emitting layer interposed between the anode and the cathode. The anode is independent for each pixel, whereas the cathode may be a common electrode shared by all pixels. When drive current is supplied from the drive TFT DT to the OLED element, electrons from the cathode are injected into the organic light emitting layer, and holes from the anode are injected into the organic light emitting layer. In accordance with re-combination of the electrons and holes in the organic light emitting layer, light is emitted from a fluorescent material or a phosphorescent material. Thus, the OLED element generates light having brightness proportional to the value of the drive current.

The first switching TFT ST11 is controlled by a first gate line G1*n* arranged on the n-th pixel row, to connect drain and gate electrodes of the drive TFT DT for a sampling period M1 (FIG. 2). In this case, the drive TFT DT is connected to the EVDD line as a diode and, as such, operates in a saturation region.

The second switching TFT ST12 is controlled by a second gate line G2*n* arranged on the n-th pixel row, to connect the source electrode of the drive TFT DT to a data line Dm on the m-th pixel column for the sampling period M1. In this case, a current path from the EVDD line is connected to the data line Dm via the drive TFT DT.

Accordingly, during the sampling period M1, during which the first and second switching TFTs ST11 and ST12 turn on, a serial current path extending from the EVDD line while passing through the drive TFT DT of the associated pixel Pmn connected to the EVDD line as a diode, the second switching TFT ST12 and the associated data line Dm, and the target current setting unit 10*m* is established. The target current setting unit 10*m* directly sets a target current (constant current) of the drive TFT DT through adjustment of an amount of current for the associated pixel Pmn using the current path such that the current amount meets the data voltage Vd. In other words, the target current setting unit 10*m* applies a current set in accordance with the data voltage Vd before the sampling period M1. Subsequently, for the sampling period M1, the target current setting unit 10*m* adjusts an amount of current such that the current amount meets the data voltage Vd while checking the current value of the drive TFT DT and, as such, applies a target current (constant current) meeting the data voltage Vd to the drive TFT DT. The capacitor C stores a drive voltage Vgs determined based on the target current of the drive TFT DT.

For a holding period M2 in which the first and second switching TFTs ST11 and ST12 turn off, the drive TFT DT supplies, to the OLED element, the target current maintained by the drive voltage Vgs stored in the capacitor C and, as such, the OLED element emits light.

Referring to FIG. 1, the target current setting unit 10*m* includes a sink transistor SKm and a resistor Rm, which are connected in series between the associated data line Dm and the EVSS line, to establish a current path, and an amplifier Am for controlling an amount of current flowing through the sink transistor SKm based on an output voltage determined by the data voltage Vd and a feedback voltage. The target current setting unit 10*m* may be mounted within the data driver. The sink transistor SKm may be formed together with the TFTs of the pixels and, as such, may be mounted within the display panel.

Digital pixel data is converted into an analog data voltage Vd in the data driver including the target current setting unit 10*m* and, as such, the data voltage Vd is supplied to the target current setting unit 10*m*.

The data voltage Vd is supplied to a non-inverting terminal (+) of the amplifier Am. A voltage fed back from a connection node Nm between a source electrode of the sink transistor SKm and the resistor Rm is supplied to an inverting terminal (−) of the amplifier Am. An output voltage from the amplifier Am is supplied to a gate electrode of the sink transistor SKm.

Before the sampling period M1, the amplifier Am drives the sink transistor SKm by the data voltage Vd and, as such, the sink transistor SKm generates a current according to the data voltage Vd. As the switching TFTs ST11 and ST12 turn on, the generated current is applied to the drive TFT DT of the associated pixel Pmn establishing a current path together with the data line Dm.

For the sampling period M1, the amplifier Am checks whether the value of the current applied to the drive TFT DT meets the data voltage Vd, based on the voltage fed back from the connection node N1 between the source electrode of the sink transistor SKm and the resistor Rm. The feedback voltage on the connection node Nm is proportional to a value of the current sunk through the current path and a resistance value R of the resistor Rm and, as such, it may be possible to check whether the value of the current flowing through the drive TFT DT meets the data voltage Vd, based on the feedback voltage. The amplifier Am compares the data voltage Vd with the feedback voltage, and adjusts the output voltage thereof such that the feedback voltage approaches the data voltage Vd, thereby controlling the current amount of the sink transistor SKm.

For example, when the feedback voltage is less than the data voltage Vd, the amplifier Am increases the output voltage thereof, to increase the amount of current. On the other hand, when the feedback voltage is more than the data voltage Vd, the amplifier Am decreases the output voltage thereof, to decrease the amount of current.

Thus, the target current setting unit 10*m* may directly set a target current (constant current) meeting the data voltage Vd, and may apply the target current to the drive TFT DT establishing a current path.

Hereinafter, driving of the pixel Pmn illustrated in FIG. 1 will be described with reference to the waveform diagram of FIG. 2.

In the sampling period M1, the second switching TFT ST12 turns on in response to a gate-on voltage supplied to the second gate line G2*n*, and the first switching TFT ST11 turns on in response to a gate-on voltage supplied to the first gate line G1*n*. Accordingly, the drive TFT DT is connected to the EVDD line by the turned-on first switching TFT ST11 in such a manner that the drive TFT DT serves as a diode, to operate in a saturation region, and, as such, establishes a current path passing through the associated data line Dm and the target current setting unit 10*m*, together with the turned-on second switching TFT ST12.

During the sampling period M1, the target current setting unit 10*m* checks the current value of the drive TFT DT, using the current path extending from the EVDD line while passing through the drive TFT DT of the associated pixel Pmn, the second switching TFT ST12, the associated data line Dm, the sink transistor SKm and the resistor Rm, and adjusts the current value of the drive TFT DT based on the checked results, to set a target current (constant current) of the drive TFT DT meeting the data voltage Vd. The capacitor C of the associated pixel Pmn stores a drive voltage Vgs determined based on the target current of the drive TFT DT.

During the sampling period M1, the target current setting unit 10*m* performs a control operation to apply, to the anode of the OLED element, an OFF voltage lower than a threshold voltage of the OLED element, to turn off the OLED element. As the target current setting unit 10*m* adjusts the current value of the drive TFT DT through appropriate setting of design values of the amplifier Am, sink transistor SKm and resistor Rm, the target current setting unit 10*m* may apply an OFF voltage to the anode of the OLED element during the sampling period M1.

In the holding period M2, the first switching TFT ST11 turns off in response to a gate-off voltage supplied to the first gate line G1*n*, and the second switching TFT ST12 turns off in response to a gate-off voltage supplied to the second gate line G2*n*. Accordingly, the drive TFT DT supplies, to the OLED element, the target current maintained by the drive voltage Vgs stored in the capacitor C and, as such, the OLED element emits light.

Meanwhile, the frame period of the OLED display device may further include a first period t1 just before the sampling period M1. In the first period t1, the second switching TFT ST12 turns on before the first switching TFT ST11 turns on in the sampling period M1, to discharge the drive voltage Vgs stored in the capacitor C for the drive TFT DT in a previous frame period.

In addition, the frame period of the OLED display device may further include a second period t2 executed between the sampling period M1 and the holding period M2. In the second period t2, the first switching TFT ST11 turns off before the second switching TFT ST12 turns off in the holding period M2, to prevent the drive voltage Vgs stored in the capacitor C for the drive TFT DT from varying. When the second switching TFT ST12 turns off before the first switching TFT ST11 turns off, the source voltage of the drive TFT DT may be varied due to the current flowing through the drive TFT DT and, as such, the drive voltage Vgs stored in the capacitor C may be varied. As a result, there may be a problem in that the value of the current supplied to the OLED element may be varied. However, when the first switching TFT ST11 turns off before the second switching TFT ST11 turns off, the gate electrode of the drive TFT DT is floated. Accordingly, when the source voltage is varied due to the current flowing through the drive TFT DT, the gate voltage of the drive TFT DT is also varied and, as such, the drive voltage Vgs stored in the capacitor C may be maintained without variation.

As described above, the OLED display device according to the first embodiment of the present disclosure directly sets the target current of the drive TFT DT meeting the data voltage Vd, using the target current setting unit 10*m* provided for each data line Dm and, as such, may supply a uniform target current to the associated OLED element, irrespective of deviation of characteristics of the drive TFT DT. Accordingly, it may be possible to avoid non-uniformity of luminance caused by deviation of characteristics of drive TFTs DT among the pixels.

Figure 3:
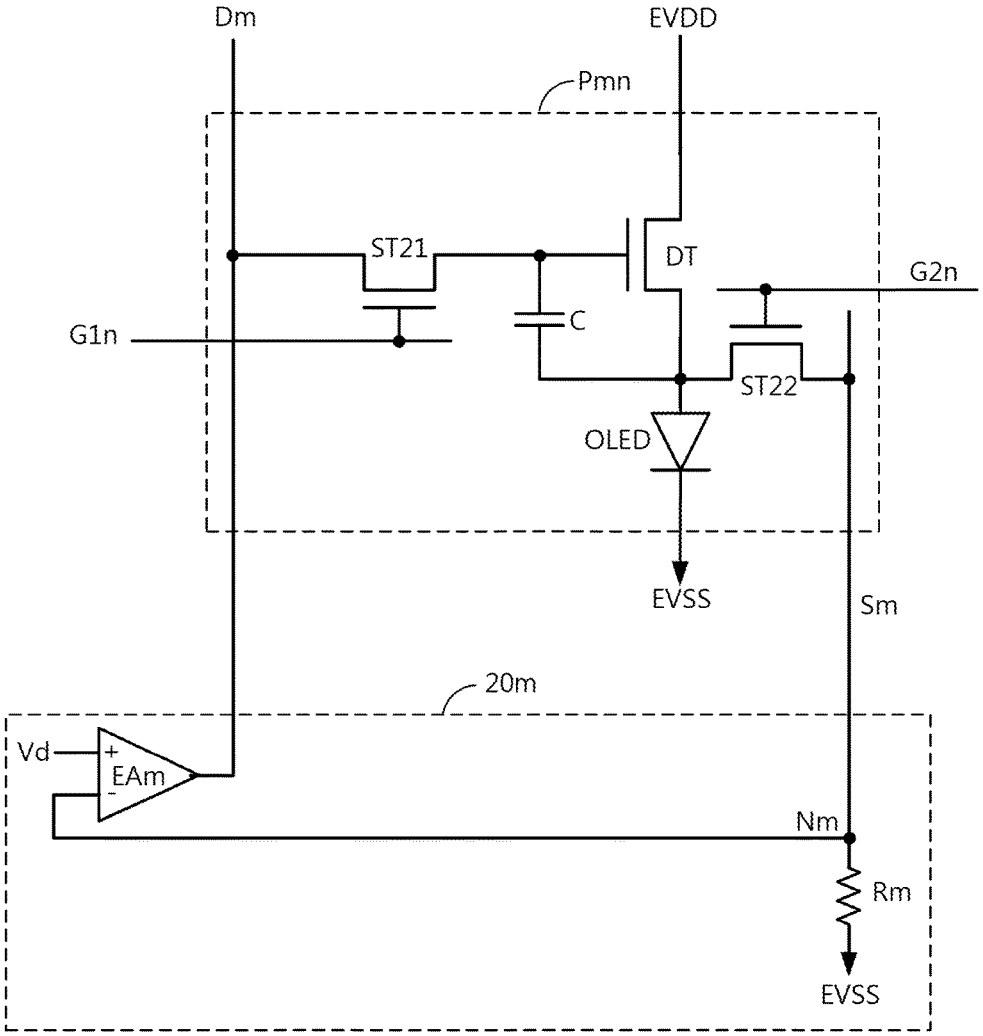
FIG. 3 is a circuit diagram illustrating a configuration of a part of an OLED display device according to a second embodiment of the present disclosure.
Figure 4:
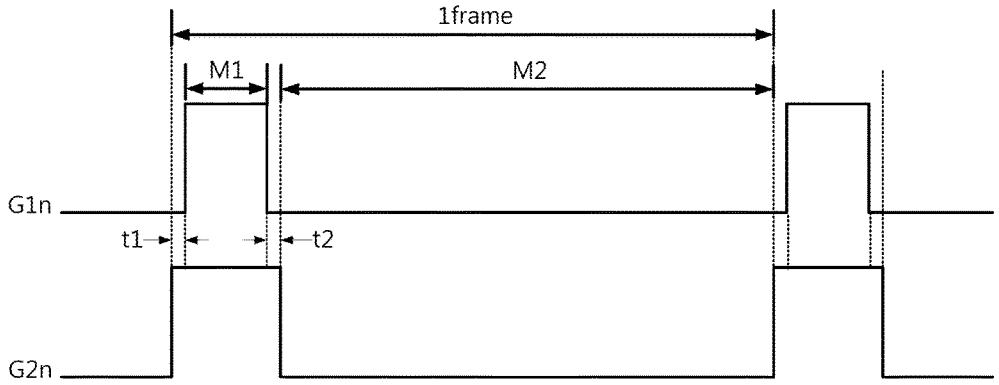
FIG. 4 is a waveform diagram illustrating driving of a pixel shown in FIG. 3.

FIG. 3 is a circuit diagram illustrating a configuration of a part of an OLED display device according to a second embodiment of the present disclosure, namely, one pixel and one target current setting unit. FIG. 4 is a waveform diagram illustrating driving of a pixel shown in FIG. 3.

The second embodiment differs from the first embodiment in that, in the pixel Pmn according to the second embodiment, a first switching TFT ST21 is controlled by the first gate line G1*n* of the n-th pixel row, to connect the gate electrode of the drive TFT DT to the data line Dm of the m-th pixel column for the sampling period M1, and a second switching TFT ST22 is controlled by the second gate line G2*n* of the n-th pixel row, to connect the source electrode of the drive TFT DT to a sensing line Sm of the m-th pixel column for the sampling period M1.

In addition, the second embodiment differs from the first embodiment in that a target current setting unit 20*m* includes an error amplifier EAm having a non-inverting terminal (+), to which the data voltage Vd is supplied, an inverting terminal (−) connected to the connection node Nm between the sensing line Sm and the sensing resistor Rm, and an output terminal connected to the data line Dm, and the target current setting unit 20*m* also includes the sensing resistor Rm, which is connected between the sensing line Sm and the EVSS line.

Before the sampling period M1, the error amplifier EAm supplies the data voltage Vd to the data line Dm. For the sampling period M1, the error amplifier EAm compares the data voltage Vd with a feedback voltage determined based on the current value of the drive TFT DT fed back from the associated pixel Pmn via the sensing line Sm, and compensates a voltage output from the data line Dm such that the feedback voltage approaches the data voltage Vd, based on the compared results. The error amplifier EAm supplies the compensated voltage to the drive TFT DT, to set the target current of the drive TFT DT meeting the data voltage Vd. The capacitor C stores a drive voltage Vgs determined based on the target current of the drive TFT DT.

Hereinafter, driving of the pixel Pmn illustrated in FIG. 3 will be described with reference to the waveform diagram of FIG. 4.

In the sampling period M1, the second switching TFT ST22 turns on in response to a gate-on voltage supplied to the second gate line G2*n*, and the first switching TFT ST21 turns on in response to a gate-on voltage supplied to the first gate line G1*n*. Accordingly, the error amplifier EAm applies the data voltage Vd to the drive TFT DT via the data line Dm and the first switching TFT ST21. The error amplifier EAm also compensates an output voltage thereof while checking the current value of the drive TFT DT fed back via the second switching TFT ST22 and the sensing line Sm, to set a target current (constant current) of the drive TFT DT. The capacitor C of the associated pixel Pmn stores a drive voltage Vgs determined based on the target current of the drive TFT DT. During the sampling period M1, an OFF voltage lower than the threshold voltage of the OLED element is applied to the anode of the OLED element and, as such, the OLED element turns off. Application of the OFF voltage to the anode of the OLED element during the sampling period M1 may be achieved by appropriately setting design values of the error amplifier EAm and resistor Rm, thereby adjusting the amount of the supplied current.

In the holding period M2, the first switching TFT ST21 turns off in response to a gate-off voltage supplied to the first gate line G1*n*, and the second switching TFT ST22 turns off in response to a gate-off voltage supplied to the second gate line G2*n*. Accordingly, the drive TFT DT supplies, to the OLED element, the target current maintained by the drive voltage Vgs stored in the capacitor C and, as such, the OLED element emits light.

The frame period of the OLED display device may further include a first period t1 executed before the sampling period M1. In the first period t1, the second switching TFT ST22 turns on before the first switching TFT ST21 turns on, to discharge the drive voltage Vgs stored in the capacitor C for the drive TFT DT in a previous frame period.

In addition, the frame period of the OLED display device may further include a second period t2 executed between the sampling period M1 and the holding period M2. In the second period t2, the first switching TFT ST21 turns off before the second switching TFT ST22 turns off, to prevent the drive voltage Vgs stored in the capacitor C for the drive TFT DT from varying.

As described above, the OLED display device according to the second embodiment of the present disclosure sets the target current of the drive TFT DT meeting the data voltage Vd, using the target current setting unit 20*m* provided for each data line Dm and, as such, may supply a uniform target current to the associated OLED element, irrespective of deviation of characteristics of the drive TFT DT. Accordingly, it may be possible to avoid non-uniformity of luminance caused by deviation of characteristics of drive TFTs DT among the pixels.

Figure 5:
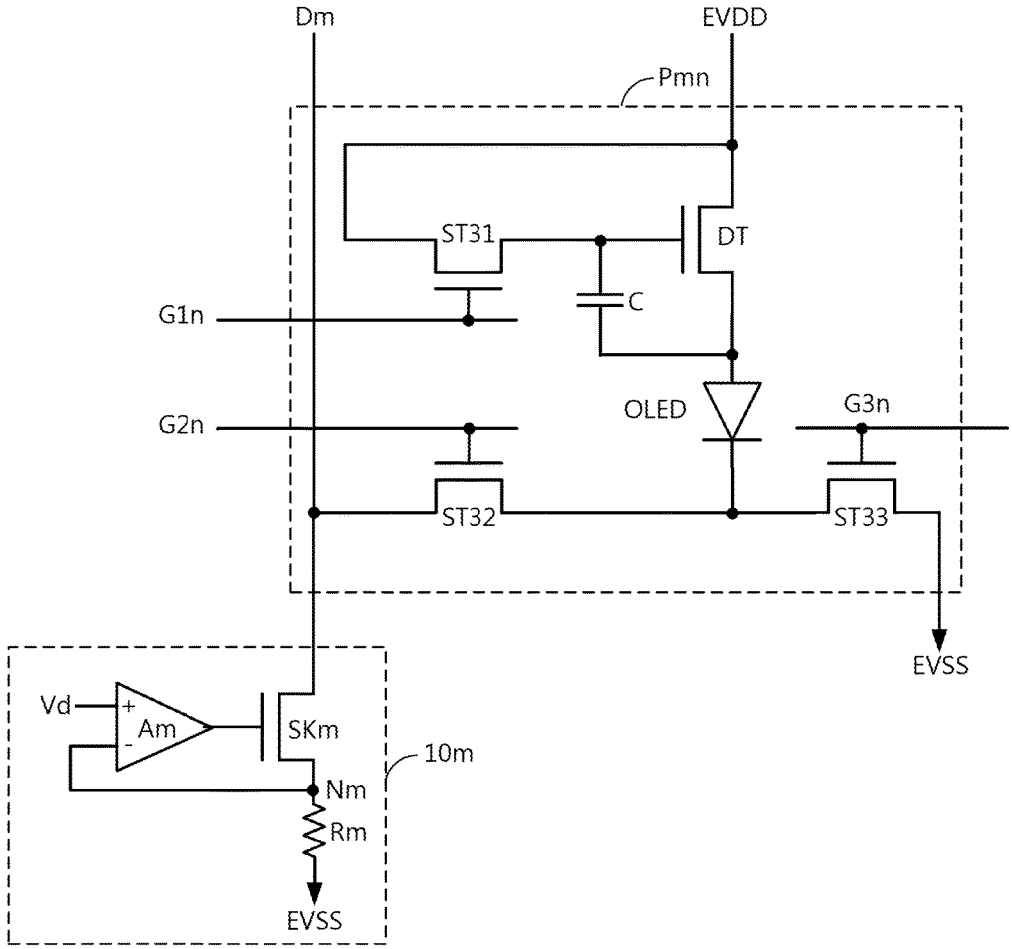
FIG. 5 is a circuit diagram illustrating a configuration of a part of an OLED display device according to a third embodiment of the present disclosure.
Figure 6:
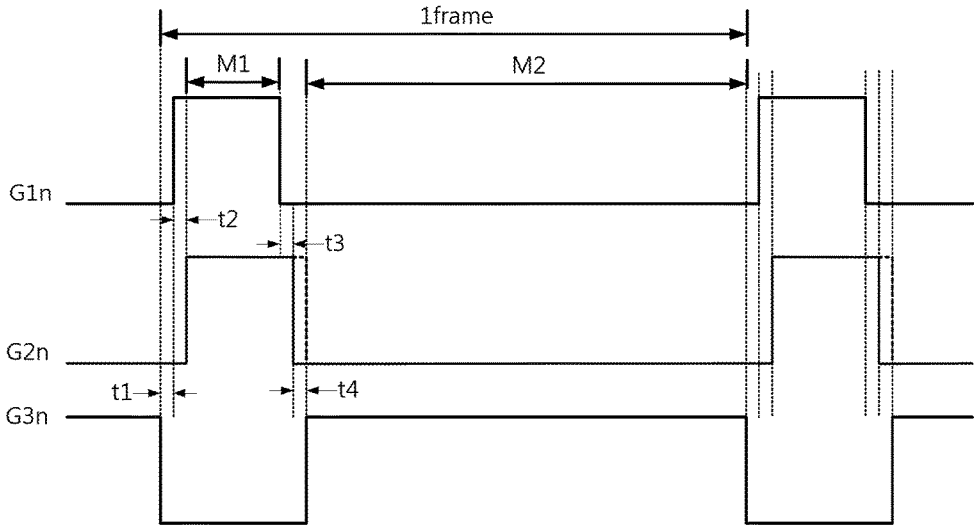
FIG. 6 is a waveform diagram illustrating driving of a pixel shown in FIG. 5.

FIG. 5 is a circuit diagram illustrating a configuration of a part of an OLED display device according to a third embodiment of the present disclosure, namely, one pixel and one target current setting unit. FIG. 6 is a waveform diagram illustrating driving of a pixel shown in FIG. 5.

The third embodiment differs from the first embodiment in that, in the pixel Pmn according to the third embodiment, a second switching TFT ST32 is controlled by the second gate line G2*n* of the n-th pixel row, to connect the cathode of the OLED element to the data line Dm for the sampling period M1, and the pixel Pmn further includes a third switching TFT ST33 controlled by a third gate line G3*n* of the n-th pixel row, to connect the cathode of the OLED element to the EVSS line for the holding period M2. The remaining configuration of the pixel Pmn and the target current setting unit 10*m* are identical to those of the first embodiment illustrated in FIG. 1 and, as such, no description thereof will be given.

Although the OLED element in the first embodiment illustrated in FIG. 1 is in an OFF state for the sampling period M1, the OLED element in the third embodiment illustrated in FIG. 5 emits light as the OLED element is included in a current path via the second switching TFT ST32 connected between the cathode of the OLED element and the data line Dm for the sampling period M1 and, as such, may achieve an enhancement in luminance, as compared to the first embodiment. In addition, the target current setting unit 10*m* sets a target current through adjustment of an amount of current flowing through the drive TFT DT and the OLED element. Accordingly, it may be possible to set a uniform target current, irrespective of deviation of driving characteristics (threshold voltage and mobility) of the drive TFT DT and deviation of driving characteristics (threshold voltage) of the OLED element.

In the third embodiment illustrated in FIG. 5, the second switching TFT ST32 may be dispensed with or otherwise not included. In this case, the data line Dm may be directly connected to the cathode of the OLED element.

Hereinafter, driving of the pixel Pmn illustrated in FIG. 5 will be described with reference to the waveform diagram of FIG. 6.

In the first period t1 executed before the sampling period M1, the third switching TFT ST33 turns off in response to a gate-off voltage supplied to the third gate line G3*n* of the n-th pixel row and, as such, the OLED element, which has emitted light, turns off.

In the sampling period M1, the first switching TFT ST31 turns on in response to a gate-on voltage supplied to the first gate line G1*n* of the n-th pixel row, and the second switching TFT ST32 turns on in response to a gate-on voltage supplied to the second gate line G2*n*. Accordingly, the drive TFT DT is connected to the EVDD line by the turned-on first switching TFT ST31 in such a manner that the drive TFT DT serves as a diode, to operate in a saturation region, and, as such, establishes a current path extending from the EVDD line while passing through the drive TFT DT, OLED element and second switching TFT ST32 of the associated pixel Pmn, the associated data line Dm, the sink transistor SKm and the resistor Rm, together with the turned-on second switching TFT ST32. The target current setting unit 10*m* checks the value of the current flowing through the OLED element via the drive TFT DT, based on the data voltage Vd, and adjusts the current value of the drive TFT DT based on the checked results, to set a target current (constant current) of the drive TFT DT meeting the data voltage Vd. The capacitor C of the associated pixel Pmn stores a drive voltage Vgs determined based on the target current flowing through the OLED element via the drive TFT DT.

In the holding period M2, the first switching TFT ST11 turns off in response to a gate-off voltage supplied to the first gate line G1*n*, and the second switching TFT ST32 turns off in response to a gate-off voltage supplied to the second gate line G2*n*. In addition, the third switching TFT ST33 turns on in response to a gate-on voltage supplied to the third gate line G3*n* and, as such, the cathode of the OLED element is connected to the EVSS line. Accordingly, a current path is established, which passes through the EVDD line, the drive TFT DT, the OLED element, the third switching TFT ST33 and the EVSS line and, as such, the OLED element emits light by a target current maintained by the drive voltage Vgs stored in the capacitor C.

The frame period of the OLED display device may further include a second period t2 executed between the first period t1 and the sampling period M1. In the second period t2, the first switching TFT ST31 turns on before the second switching TFT ST32 turns on. The second period t2 is a period in which the sink transistor SKm performs current setting based on the data voltage Vd in the current frame period. The second period t2 may prevent the current in the previous frame period from flowing into the sink transistor SKm via the second switching transistor ST32.

In addition, the frame period of the OLED display device may further include a third period t3 executed between the sampling period M1 and the holding period M2. In the third period t3, the first switching TFT ST31 turns off before the second switching TFT ST32 turns off, to prevent the drive voltage Vgs stored in the capacitor C for the drive TFT DT from varying.

The frame period of the OLED display device may further include a fourth period t4 executed between the third period t3 and the holding period M2. In the fourth period t4, the second switching TFT ST32 turns off before the third switching TFT ST33 turns on. Alternatively, in the holding period M2, the third switching TFT ST33 turns on, simultaneously with turning-off of the second switching TFT ST32. In this case, accordingly, it may be possible to prevent the current path passing through the OLED element from being separated into parallel structures. As a result, a variation in target current may be prevented.

Meanwhile, in the pixel Pmn illustrated in FIG. 5, the second switching TFT ST32 and second gate line G2*n* may be dispensed with or otherwise not included. In this case, the driving waveform of the second gate line G2*n* may be omitted from FIG. 6.

As described above, the OLED display device according to the third embodiment of the present disclosure directly sets the target current of the drive TFT DT meeting the data voltage Vd, using the target current setting unit 10*m* provided for each data line Dm and, as such, may supply a uniform target current to the associated OLED element, irrespective of deviation of characteristics of the drive TFT DT. Accordingly, it may be possible to avoid non-uniformity of luminance caused by deviation of characteristics of drive TFTs DT among the pixels. In addition, in the third embodiment, it may be possible to reduce power consumption, as compared to the first embodiment, because the OLED element emits light during the sampling period M1, in which the target current is set, and, as such, contributes to an enhancement in luminance.

Figure 7:
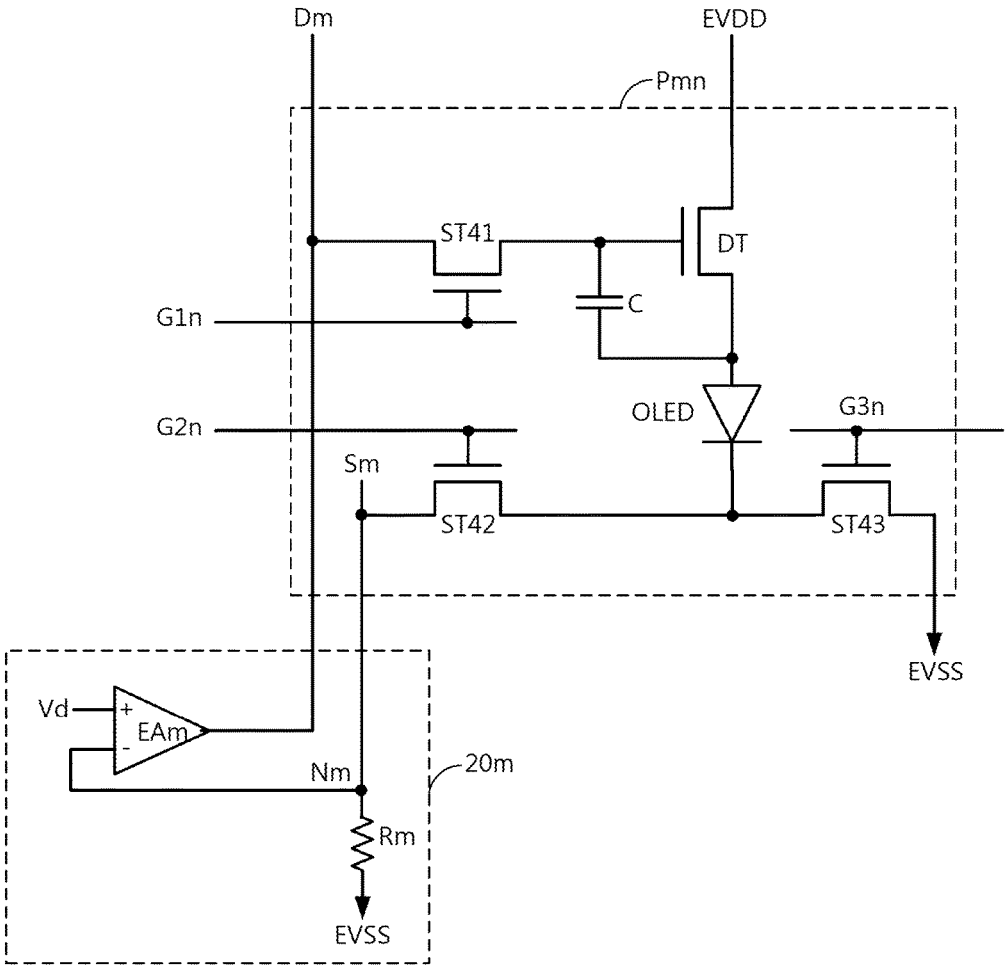
FIG. 7 is a circuit diagram illustrating a configuration of a part of an OLED display device according to a fourth embodiment of the present disclosure.
Figure 8:
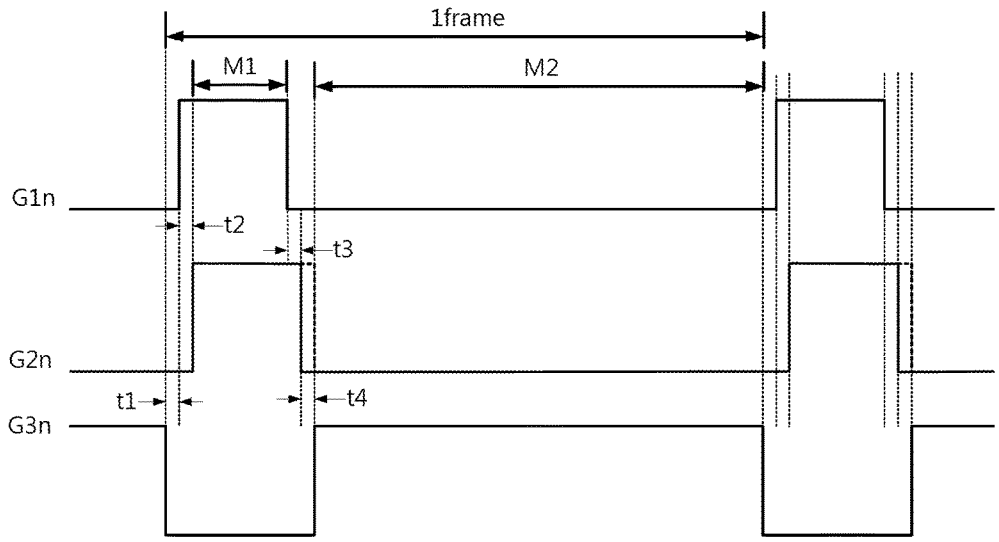
FIG. 8 is a waveform diagram illustrating driving of a pixel shown in FIG. 7.

FIG. 7 is a circuit diagram illustrating a configuration of a part of an OLED display device according to a fourth embodiment of the present disclosure, namely, one pixel and one target current setting unit. FIG. 8 is a waveform diagram illustrating driving of a pixel shown in FIG. 7.

The fourth embodiment illustrated in FIG. 7 differs from the second embodiment illustrated in FIG. 3 in that, in the pixel Pmn according to the fourth embodiment, a second switching TFT ST42 is controlled by the second gate line G2*n* of the n-th pixel row, to connect the cathode of the OLED element to the sensing line Sm for the sampling period M1. The pixel Pmn further includes a third switching TFT ST43 controlled by the third gate line G3*n* of the n-th pixel row, to connect the cathode of the OLED element to the EVSS line for the holding period M2. The remaining configuration of the pixel Pmn and the target current setting unit 10*m* are identical to those of the second embodiment illustrated in FIG. 3 and, as such, no description thereof will be given.

In the pixel Pmn illustrated in FIG. 7, the second switching TFT ST42 and second gate line G2*n* may be dispensed with or otherwise not included. In this case, the sensing line Sm may be directly connected to the cathode of the OLED element.

Although the OLED element in the second embodiment illustrated in FIG. 3 is in an OFF state for the sampling period M1, the OLED element in the fourth embodiment illustrated in FIG. 7 emits light as the OLED element is included in a current path via the second switching TFT ST42 connected between the cathode of the OLED element and the sensing line Sm for the sampling period M1 and, as such, may achieve an enhancement in luminance, as compared to the second embodiment. In addition, the target current setting unit 20*m* sets a target current through adjustment of an amount of current flowing through the drive TFT DT and the OLED element. Accordingly, it may be possible to set a uniform target current, irrespective of deviation of driving characteristics (threshold voltage and mobility) of the drive TFT DT and deviation of driving characteristics (threshold voltage) of the OLED element.

Hereinafter, driving of the pixel Pmn illustrated in FIG. 7 will be described with reference to the waveform diagram of FIG. 8.

In the first period t1 executed before the sampling period M1, the third switching TFT ST43 turns off in response to a gate-off voltage supplied to the third gate line G3*n* of the n-th pixel row and, as such, the OLED element, which has emitted light, turns off.

In the sampling period M1, the first switching TFT ST41 turns on in response to a gate-on voltage supplied to the first gate line G1*n*, and the second switching TFT ST42 turns on in response to a gate-on voltage supplied to the second gate line G2*n*. Accordingly, the error amplifier EAm applies the data voltage Vd to the drive TFT DT via the data line Dm and the first switching TFT ST41. The error amplifier EAm also compensates an output voltage thereof while checking the value of the current fed back via the drive TFT DT, the OLED element, the second switching TFT ST42 and the sensing line Sm, to set a target current (constant current) flowing through the drive TFT DT and the OLED element. The capacitor C of the associated pixel Pmn stores a drive voltage Vgs determined based on the target current of the drive TFT DT.

In the holding period M2, the first switching TFT ST41 turns off in response to a gate-off voltage supplied to the first gate line G1*n*, and the second switching TFT ST42 turns off in response to a gate-off voltage supplied to the second gate line G2*n*. In addition, the third switching TFT ST43 turns on in response to a gate-on voltage supplied to the third gate line G3*n* and, as such, the cathode of the OLED element is connected to the EVSS line. Accordingly, a current path is established, which passes through the EVDD line, the drive TFT DT, the OLED element, the third switching TFT ST43 and the EVSS line and, as such, the OLED element emits light by a target current maintained by the drive voltage Vgs stored in the capacitor C.

The frame period of the OLED display device may further include a second period t2 executed between the first period t1 and the sampling period M1. In the second period t2, the second switching TFT ST42 turns on after turning-on of the first switching TFT ST41, to prevent the current in the previous frame period from flowing into the error amplifier EAm.

In addition, the frame period of the OLED display device may further include a third period t3 executed between the sampling period M1 and the holding period M2. In the third period t3, the first switching TFT ST41 turns off before the second switching TFT ST42 turns off, to prevent the drive voltage Vgs stored in the capacitor C for the drive TFT DT from varying.

The frame period of the OLED display device may further include a fourth period t4 executed between the third period t3 and the holding period M2. In the fourth period t4, the second switching TFT ST42 turns off before the third switching TFT ST43 turns on. Alternatively, in the holding period M2, the third switching TFT ST43 turns on, simultaneously with turning-off of the second switching TFT ST42. In this case, accordingly, it may be possible to prevent the current path passing through the OLED element from being separated into parallel structures. As a result, a variation in target current may be prevented.

Meanwhile, in the pixel Pmn illustrated in FIG. 7, the second switching TFT ST42 and second gate line G2*n* may be dispensed with or otherwise not included. In this case, the driving waveform of the second gate line G2*n* may be omitted from FIG. 8.

As described above, the OLED display device according to the fourth embodiment of the present disclosure directly sets the target current of the drive TFT DT meeting the data voltage Vd, using the target current setting unit 20*m* provided for each data line Dm and, as such, may supply a uniform target current to the associated OLED element, irrespective of deviation of characteristics of the drive TFT DT. Accordingly, it may be possible to avoid non-uniformity of luminance caused by deviation of characteristics of drive TFTs DT among the pixels. In addition, in the fourth embodiment, it may be possible to reduce power consumption, as compared to the first embodiment, because the OLED element emits light during the sampling period M1, in which the target current is set, and, as such, contributes to an enhancement in luminance.

Figure 9:
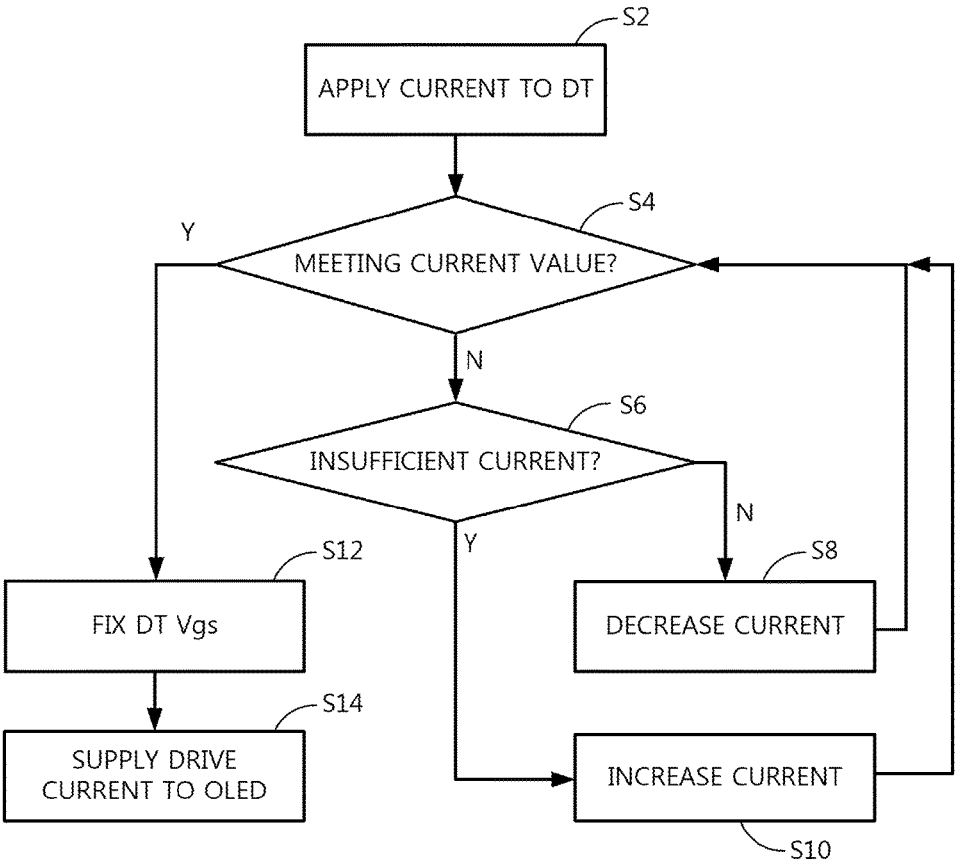
FIG. 9 is a flowchart illustrating a pixel driving method of an OLED display device according to an embodiment of the present disclosure.

FIG. 9 illustrates a pixel driving method of an OLED display device according to embodiments of the present disclosure in a sequential manner. The pixel driving method may be applied to all embodiments described with reference to FIGS. 1 to 8.

In operation S2, the target current setting unit 10*m* or 20*m* performs a control operation to apply a current corresponding to the data voltage Vd to the drive TFT DT of the associated pixel Pmn.

In operation S4, the target current setting unit 10*m* or 20*m* compares the data voltage Vd with a feedback voltage determined based on a current value of the drive TFT DT, and determines whether the current value of the drive TFT DT meets the data voltage Vd, based on the compared results.

Upon determining, in operation S4, that the current value of the drive TFT DT does not meet the data voltage Vd ("N"), the target current setting unit 10*m* or 20*m* proceeds to operations S6 to S10, to set a current value meeting the data voltage Vd as a target current. Setting of the target current is achieved by decreasing or increasing the amount of current flowing through the drive TFT DT through adjustment of the output voltage of the amplifier Am or EAm according to whether or not the current value is insufficient.

Upon determining, in operation S4, that the current value of the drive TFT DT meets the data voltage Vd ("Y"), that is, when the current value of the drive TFT DT meeting the data voltage Vd is set as the target current, a drive voltage Vgs determined based on the target current is stored in a fixed state in the capacitor C of the associated pixel Pmn in operation S12. In operation S14, a drive current (target current) according to the drive voltage Vgs of the drive TFT DT is supplied to the OLED element and, as such, the OLED element emits light.

As apparent from the above description, the OLED display device according to embodiments of the present disclosure directly sets the target current of the drive TFT meeting the data voltage, using the target current setting unit 10*m* provided for each data line and, as such, may supply a uniform target current to the associated OLED element, irrespective of deviation of characteristics of the drive TFT. Accordingly, it may be possible to avoid non-uniformity of luminance caused by deviation of characteristics of drive TFTs among the pixels.

Accordingly, the OLED display device according to embodiments of the present disclosure requires no external compensation in the process of manufacturing the OLED display device and, as such, process expense may be reduced. In addition, in the process of practically driving the OLED display device, no external compensation is required. Accordingly, loss of time may be prevented. Furthermore, for acquisition of compensation values, it is unnecessary to use a sensing circuit, a computation circuit, a memory and so on. As a result, the number of circuit elements and the circuit area may be reduced and, as such, circuit element expense may be greatly reduced.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting diode display device comprising:

a pixel; and a target current setting circuit connected to the pixel via a data line, and configured to set a target current corresponding to a data voltage during a sampling period, before a holding period, for driving an organic light emitting diode (OLED) element in the pixel during the holding period, wherein the pixel includes:

a drive thin film transistor (TFT) for driving the OLED element, a first switching TFT controlled by a first gate line, and configured to connect a gate electrode of the drive TFT to a first power line during the sampling period to cause the drive TFT to serve as a diode, a second switching TFT controlled by a second gate line, and configured to connect a source electrode of the drive TFT to the data line during the sampling period, and a capacitor connected between a gate electrode of the drive TFT and the source electrode of the drive TFT, and configured to store a drive voltage for the drive TFT determined based on the target current, wherein the target current setting circuit includes:

a sink TFT and a resistor connected in series between the data line and a second power line; and an amplifier for controlling an amount of current flowing through the sink TFT based on the data voltage before the sampling period, comparing the data voltage with a voltage fed back through a connection node between the sink TFT and the resistor during the sampling period, and controlling the amount of current flowing through the sink TFT based on the comparison.

2. The organic light emitting diode display device according to claim 1, wherein a frame period of the OLED display device includes the sampling period, the holding period, a first period before the sampling period, and a second period between the sampling period and the holding period, the OLED display device being configured to:

turn on the second switching TFT before turning on the first switching TFT during the first period; and turn off the first switching TFT before turning off the second switching TFT during the second period.

3. An organic light emitting diode display device comprising:

a pixel; and a target current setting circuit connected to the pixel via a data line, and configured to set a target current corresponding to a data voltage during a sampling period, before a holding period, for driving an organic light emitting diode (OLED) element in the pixel during the holding period, wherein the pixel includes:

a drive thin film transistor (TFT) for driving the OLED element, a first switching TFT controlled by a first gate line, and configured to connect a gate electrode of the drive TFT to a first power line during the sampling period to cause the drive TFT to serve as a diode, a second switching TFT controlled by a second gate line, and configured to connect a cathode of the OLED element to a second power line during the holding period, and a capacitor connected between the gate electrode of the drive TFT and a source electrode of the drive TFT, and configured to store a drive voltage for the drive TFT determined based on the target current, wherein the target current setting circuit includes:

a sink TFT and a resistor connected in series between the data line and the second power line; and an amplifier which, in use, controls an amount of current flowing through the sink TFT based on the data voltage before the sampling period, compares the data voltage with a voltage fed back through a connection node between the sink TFT and the resistor during the sampling period, and controls the amount of current flowing through the sink TFT based on the comparison.

4. The organic light emitting diode display device according to claim 3, wherein the pixel further includes a third switching TFT controlled by a third gate line, and configured to connect the cathode of the OLED element to the data line during the sampling period.

5. The organic light emitting diode display device according to claim 4, wherein the organic light emitting diode display device is configured to:

turn off the second switching TFT during a first period executed before the sampling period;

turn on the first switching TFT before turning on the third switching TFT during a second period executed between the first period and the sampling period; and turn off the first switching TFT before turning off the third switching TFT during a third period executed between the sampling period and the holding period.

6. The organic light emitting diode display device according to claim 5, wherein the organic light emitting diode display device is configured to simultaneously turn on the second switching TFT and turn off the third switching TFT upon starting the holding period.

7. The organic light emitting diode display device according to claim 5, wherein the organic light emitting diode display device is configured to turn off the third switching TFT before turning on the second switching TFT during a fourth period executed between the third period and the holding period.

8. An organic light emitting diode display device comprising:

a pixel; and a target current setting circuit connected to the pixel via a data line and a sensing line, and configured to set a target current corresponding to a data voltage during a sampling period, before a holding period, for driving an organic light emitting diode (OLED) element in the pixel during the holding period, wherein the pixel includes:

a drive thin film transistor (TFT) for driving the OLED element, a first switching TFT controlled by a first gate line, and configured to connect a gate electrode of the drive TFT to the data line during the sampling period, a second switching TFT controlled by a second gate line, and configured to connect a source electrode of the drive TFT to the sensing line during the sampling period, and a capacitor connected between the gate electrode of the drive TFT and the source electrode of the drive TFT, and configured to store a drive voltage for the drive TFT determined based on the target current, wherein the target current setting circuit includes:

a sensing resistor connected between the sensing line and a power supply line; and an error amplifier for applying the data voltage to the data line before the sampling period, and compensating a voltage output from the data line in accordance with a voltage fed back through a connection node between the sensing line and the sensing resistor during the sampling period.

9. The organic light emitting diode display device according to claim 8, wherein a frame period of the OLED display device includes the sampling period, the holding period, a first period before the sampling period, and a second period between the sampling period and the holding period, the OLED display device being configured to:

turn on the second switching TFT before turning on the first switching TFT during the first period; and turn off the first switching TFT before turning off the second switching TFT during the second period.

10. An organic light emitting diode display device comprising:

a pixel; and a target current setting circuit connected to the pixel via a data line and a sensing line, and configured to set a target current corresponding to a data voltage during a sampling period, before a holding period, for driving an organic light emitting diode (OLED) element in the pixel during the holding period, wherein the pixel includes:

a drive thin film transistor (TFT) for driving the OLED element, a first switching TFT controlled by a first gate line, and configured to connect a gate electrode of the drive TFT to the data line during the sampling period, a second switching TFT controlled by a second gate line, and configured to connect a cathode of the OLED element to a power line during the holding period, and a capacitor connected between the gate electrode of the drive TFT and the source electrode of the drive TFT, and configured to store a drive voltage for the drive TFT determined based on the target current, wherein the target current setting circuit includes:

a sensing resistor connected between the sensing line and the power line; and an error amplifier for applying the data voltage to the data line before the sampling period, and compensating a voltage output from the data line in accordance with a voltage fed back through a connection node between the sensing line and the sensing resistor during the sampling period.

11. The organic light emitting diode display device according to claim 10, wherein the pixel further includes a third switching TFT controlled by a third gate line, and configured to connect the cathode of the OLED element to the sensing line during the sampling period.

12. The organic light emitting diode display device according to claim 11, wherein the organic light emitting diode display device is configured to:

turn off the second switching TFT during a first period executed before the sampling period;

turn on the first switching TFT before turning on the third switching TFT during a second period executed between the first period and the sampling period; and turn off the first switching TFT before turning off the third switching TFT during a third period executed between the sampling period and the holding period.

13. The organic light emitting diode display device according to claim 12, wherein the organic light emitting diode display device is configured to simultaneously turn on the second switching TFT and turn off the third switching TFT upon starting the holding period.

14. The organic light emitting diode display device according to claim 12, wherein the organic light emitting diode display device is configured to turn off the third switching TFT before turning on the second switching TFT during a fourth period executed between the third period and the holding period.

15. A method for driving a pixel of a display device, comprising:

supplying a data voltage to a target current setting circuit that is coupled to the pixel via a data line, the target current setting circuit including a sink transistor and a resistor, and an amplifier configured to receive the data voltage;

setting a target current, by the target current setting circuit, corresponding to the data voltage during a sampling period, the sampling period occurring before a holding period;

coupling, via a first switching transistor, a gate electrode of a drive transistor to a first power supply line during the sampling period to cause the drive transistor to operate as a diode;

coupling, via a second switching transistor, a source electrode of the drive transistor to the data line during the sampling period;

storing a drive voltage that is based on the target current, by a capacitor coupled between the gate and source electrodes of the drive transistor;

driving an organic light emitting diode (OLED) element of the pixel by controlling the drive transistor during the holding period based on the stored drive voltage;

controlling, by the amplifier, an amount of current flowing through the sink transistor based on the data voltage before the sampling period, the sink transistor and the resistor being connected in series between the data line and a second power line;

comparing the data voltage with a voltage fed back through a connection node between the sink transistor and the resistor during the sampling period; and adjusting the amount of current flowing through the sink transistor based on the comparison.

* * * * *